US011419361B2

(12) United States Patent
Sebastian

(10) Patent No.: US 11,419,361 B2
(45) **Date of Patent: *Aug. 23, 2022**

(54) METHOD AND SYSTEM FOR PROVIDING A HEAT-NOT-BURN TOBACCO PRODUCT

(71) Applicant: Andries Don Sebastian, Kathleen, GA (US)

(72) Inventor: Andries Don Sebastian, Kathleen, GA (US)

(73) Assignee: IP CONCEPTS LLC, Perry, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/397,955

(22) Filed: Aug. 9, 2021

(65) Prior Publication Data

US 2022/0022527 A1 Jan. 27, 2022

Related U.S. Application Data

(63) Continuation of application No. 17/112,071, filed on Dec. 4, 2020, now Pat. No. 11,083,215.
(Continued)

(51) Int. Cl.

| | |
|---|---|
| ***A24F 40/30*** | (2020.01) |
| ***A24D 1/22*** | (2020.01) |
| ***A24F 40/48*** | (2020.01) |
| ***A24F 40/10*** | (2020.01) |
| ***A24F 40/46*** | (2020.01) |

(Continued)

(52) U.S. Cl.
CPC ..... *A24D 1/22* (2020.01); *A24D 1/02* (2013.01); *A24D 1/20* (2020.01); *A24F 40/10* (2020.01); *A24F 40/20* (2020.01); *A24F 40/30* (2020.01); *A24F 40/46* (2020.01); *A24F 40/465* (2020.01); *A24F 40/48* (2020.01); *A24F 40/57* (2020.01)

(58) Field of Classification Search
CPC ..... A24F 40/30
See application file for complete search history.

(56) References Cited

U.S. PATENT DOCUMENTS

| | | | |
|---|---|---|---|
| 5,050,621 | A | 9/1991 | Creighton et al. |
| 2011/0126848 | A1 | 6/2011 | Zuber et al. |

(Continued)

FOREIGN PATENT DOCUMENTS

| | | | |
|---|---|---|---|
| WO | 2014037270 | A1 | 3/2014 |

OTHER PUBLICATIONS

PCT/US21/61877, International Filing Date: Dec. 3, 2021; International Search Report & Written Opinion Transmitted dated Mar. 17, 2022.

*Primary Examiner* — Cynthia Szewczyk
(74) *Attorney, Agent, or Firm* — Smith Tempel; Steven P. Wigmore

(57) ABSTRACT

A heat-not-burn tobacco aerosol source member or consumable includes a first heating section with a front end. The first heating section contains a liquid aerosol precursor existing as a free liquid in an unbound form. A second heating section is provided with a mouth end. The second heating section contains a solid tobacco substrate. A first thermal barrier that is vapor permeable but liquid impermeable is located between the first heating section and the second heating section. The system has a simple structure and lowers processing costs, and greatly reduces undesirable harmful chemicals because of its lower heating temperatures for the first and second heating sections of the consumable.

20 Claims, 8 Drawing Sheets

Related U.S. Application Data

(60) Provisional application No. 62/974,589, filed on Dec. 13, 2019.

(51) Int. Cl.

| | |
|---|---|
| ***A24F 40/465*** | (2020.01) |
| ***A24F 40/20*** | (2020.01) |
| ***A24F 40/57*** | (2020.01) |
| ***A24D 1/20*** | (2020.01) |
| ***A24D 1/02*** | (2006.01) |

(56) References Cited

U.S. PATENT DOCUMENTS

| | | | | |
|---|---|---|---|---|
| 2012/0255567 | A1* | 10/2012 | Rose | A61K 9/12 131/273 |
| 2014/0000638 | A1 | 1/2014 | Sebastian et al. | |
| 2014/0366898 | A1 | 12/2014 | Monsees et al. | |
| 2016/0295916 | A1 | 10/2016 | Malgat et al. | |
| 2016/0325055 | A1 | 11/2016 | Cameron | |
| 2018/0042303 | A1* | 2/2018 | Buehler | B29D 23/14 |
| 2018/0279681 | A1* | 10/2018 | Rojo-Calderon | A24C 5/01 |
| 2019/0059445 | A1* | 2/2019 | Buehler | A24F 40/10 |
| 2020/0229509 | A1 | 7/2020 | Griscik et al. | |

* cited by examiner

METHOD AND SYSTEM FOR PROVIDING A HEAT-NOT-BURN TOBACCO PRODUCT

FIELD OF THE INVENTION

The present invention relates to tobacco products and, more particularly to a heat-not-burn tobacco product.

BACKGROUND OF THE INVENTION

The Heat-not-burn (HNB) cigarette is a new type of tobacco product that is heated by electrical heat or carbon-based ignition heat. When the tobacco is heated in a HNB cigarette, substances such as nicotine and aroma in the tobacco are evaporated to produce smoke to meet the needs of smokers. Heating does not burn the cigarette at the low temperature, which is typically between about 225-350° C., compared with the traditional burn down cigarette. This greatly reduces the release of tar and harmful substances in the smoke. Because of this, the HNB cigarette is gaining more and more attention in the market, and it may soon become the mainstream direction of the tobacco industry.

Currently, the HNB cigarette generates aerosol by heating a solid substrate such as a tobacco sheet, tobacco beads or cut tobacco derived from reconstituted tobacco sheet. These solid substrates contain one or more aerosol precursors such as glycerin and propylene glycol, and water, along with other ingredients such as nicotine, and flavor compounds.

Specifically, the prior art aerosol precursors are compounded with other formulation ingredients, such as tobacco and other cellulosic fibers, polymeric binders, burn retardant agents, various flavoring agents during formation of the HNB substrate. As a result, the aerosol precursors are chemically bound to other formulation ingredients and hence the aerosol precursors of the prior art do not exist as free liquids in an unbound form.

Thus, these prior art HNB products suffer from several disadvantages: (1) they typically have a complicated manufacturing process, and high processing costs associated with forming the solid substrate containing the liquid aerosol precursors and the solid tobacco and other ingredients; (2) the solid tobacco and the aerosol precursors combined together need to be subjected to a high heating temperature such as between about 225.0 to about 350.0° C., in order to achieve sufficient vaporization of the aerosol precursors in the solid substrate, which results in the formation of undesirable tobacco based chemical compounds in the generated aerosol; and (3) a larger amount of thermal energy is needed to vaporize the aerosol precursor because it is chemically bound to other ingredients in the solid substrate. At such high temperatures, the tobacco undergoes chemical reactions and generates undesirable harmful chemicals that are inhaled by the consumer along with the formed aerosol.

The amount of aerosol precursor loaded on the prior art solid substrates is usually limited to not more than 20% by w/w (which="weight for weight" or "weight by weight", i.e. the proportion of a particular substance within a mixture, as measured by weight or mass). For example, if an aerosol precursor for a prior art solid substrate had 10 g/kg max for the entire substrate then its w/w value would be 1%).

This means that prior art solid substrates are generally dry to touch and do not require to be contained within a liquid impermeable container. And because additional thermal energy is usually needed to break those chemical bonds for the "dry" aerosol precursor within the solid prior art substrates, compared to having the aerosol precursor it in its free liquid form, the "dry" aerosol precursor may further increase the production of the harmful tobacco based chemical compounds due to the additional thermal energy.

Thus, there is a need to provide an improved heat-not-burn tobacco product to overcome the drawbacks outlined above.

SUMMARY OF THE INVENTION

One aspect of the present invention is to provide a heat-not-burn tobacco product, which has simple structure and lower processing costs, and greatly reduces undesirable harmful chemicals.

To achieve the above aspect, the present invention provides a heat-not-burn tobacco product, comprising:

a first heating section with a front end provided, the first heating section containing a liquid aerosol precursor;

a second heating section with a mouth end providing, the second heating section containing a solid tobacco substrate; and a first thermal barrier that is vapor permeable but liquid impermeable located between the first heating section and the second heating section.

In comparison with the prior art, the HNB tobacco product according to the present invention includes two heating sections for separating the liquid aerosol precursor and the solid tobacco substrate, the liquid aerosol precursor as the first heating section provides a front end, and the solid tobacco substrate as the second heating section provides a mouth end, further the first thermal barrier is formed between the first heating section and the second heating section to control the temperature, as a result, the heating temperature of the solid tobacco substrate is lower than that of the liquid aerosol precursor when heating, such as to minimize the formation of heat induced toxic chemical compounds such as TSNA's (Tobacco Specific Nitrosamines) typically formed when tobacco is heated to high temperatures. Furthermore, the separation configuration of the two heating sections is simple, which reduces manufacturing costs.

In a preferable embodiment, the first heating section further comprises a carrier substance. This carrier substance may comprise a fibrous matrix, a porous foam, or a pleated and gathered web, and the liquid aerosol precursor is loaded on to the pre-formed fibrous matrix, the pre-formed porous foam, or the pre-formed pleated and gathered web. The liquid aerosol precursor exists as a free liquid in an unbound form within the carrier substance. The carrier substance carrying the liquid aerosol precursor is usually contained/enveloped within a liquid impermeable container, such as a metal container or metalized container.

The liquid aerosol precursor in a preferred embodiment is "wet" to touch when it is within the carrier substance. The liquid aerosol may have a weight by weight (w/w) percentage that is between about 25.0% and about 600.0%, and preferably between about 30.0% and 200.0% (w/w) relative to the entire (total) weight of the carrier substance that includes the weight of the aerosol precursor. According to another exemplary embodiment, the liquid aerosol may be provided as a sole liquid/single material within the first heating section, so a w/w percentage would not be applicable to such embodiments.

As noted previously, the amount of aerosol loaded on the prior art "dry" solid substrates is usually limited to not more than 20% by w/w (which="weight for weight" or "weight by weight", i.e. the proportion of a particular substance within a mixture, as measured by weight or mass). For example, if an aerosol precursor for a prior art "dry" solid substrate had 10 g/1 kg max for the entire substrate then its w/w value would be 1% w/w relative to the weight of the substrate including the weight of the aerosol precursor present on/within the substrate.

In a preferable embodiment, it further includes a cooling section connected with the mouth end of the second heating section, and a filter connected with the cooling section.

As an embodiment, it further includes a carbon based ignition source connected to the front end of the first heating section.

Preferably, a second thermal barrier is configured between the carbon based ignition source and the first heating section.

Preferably, a third thermal barrier is connected outside of the carbon based ignition source.

As another embodiment, it further includes a first heater connected with the first heating section, and a second heater connected to the second heating section.

Preferably, it further includes a control device electrically connected with the first heater and the second heater.

Preferably, it further includes a base heater electrically connected with the control device and the first heater.

Preferably, the control device comprises a power source, a PCB, a microcontroller, a LED indicator, a charge interface and a push button activator or, puff activator or activation induced by insertion of the cigarette in to the heater.

Preferably, multiple air ventilation holes are provided to adjust any ingredient of inhalable aerosol.

Preferably, a thermal insulating layer is wrapped around the first heating section and the second heating section, and an outer paper wrap is covered on the thermal insulating layer.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the drawings, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION OF ILLUSTRATED EMBODIMENTS

Figure 1:
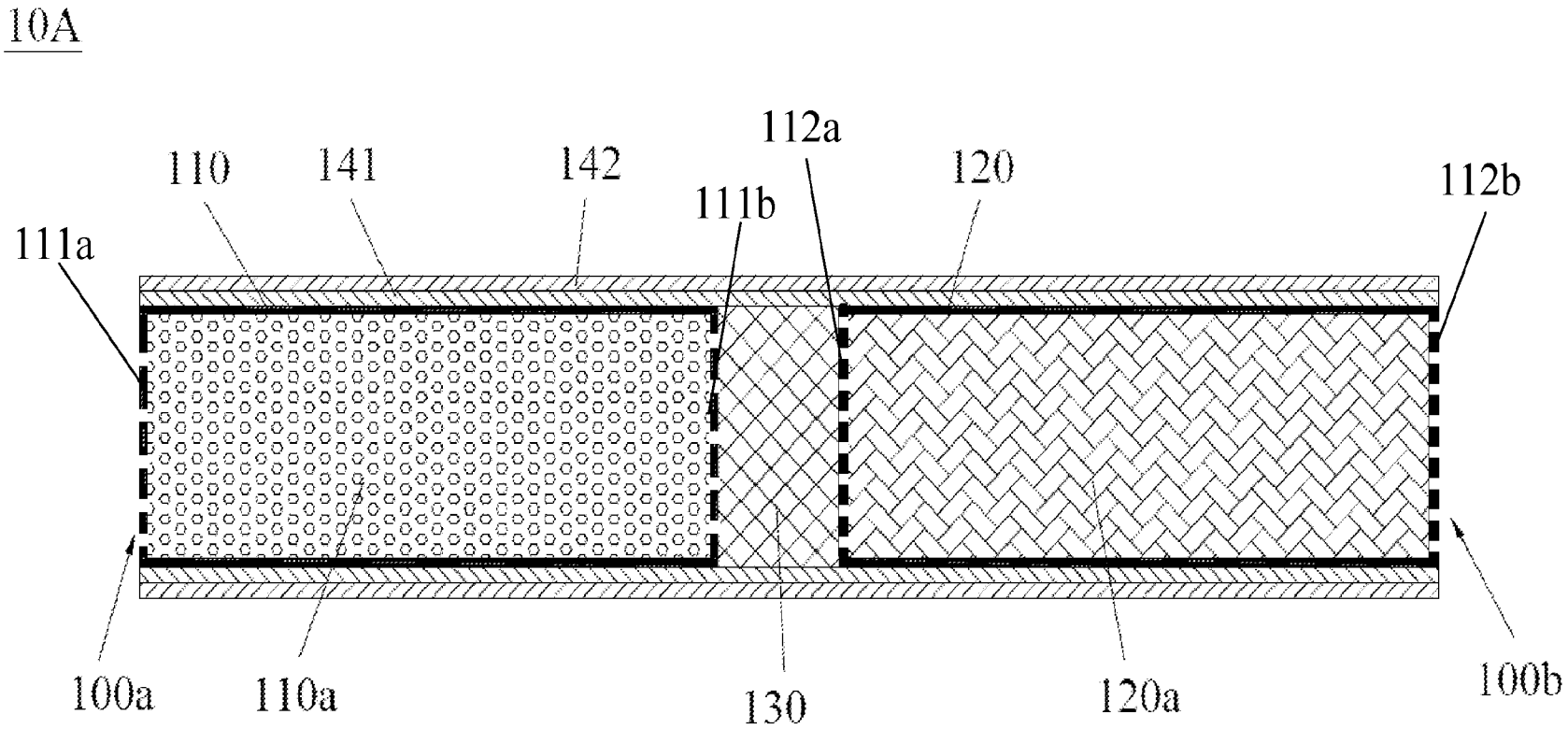
FIG. 1 is a schematic view of a heat-not-burn tobacco product according to a first embodiment of the present invention.

Various preferable embodiments of the invention will now be described with reference to the figures, wherein like reference numerals designate similar parts throughout the various views. As indicated above, the invention is directed to a heat-not-burn tobacco product, which has simple structure and lower processing costs, and greatly reduces undesirable harmful chemicals.

The present disclosure will now be described more fully hereinafter with reference to example implementations thereof. These example implementations are described so that this disclosure will be thorough and complete, and will fully convey the scope of the disclosure to those skilled in the art. Indeed, the disclosure may be embodied in many different forms and should not be construed as limited to the implementations set forth herein; rather, these implementations are provided so that this disclosure will satisfy applicable legal requirements. As used in the specification and the appended claims, the singular forms, "a" "an" 'the" and the like include plural referents unless the context clearly dictates otherwise.

In some embodiments of this disclosure use electrical energy to heat some material, to form the inhalable substance. In other embodiments the heating of the material is achieved by use of a carbon based ignition source. In both types of heating methods the material may be heated without combusting the material.

The inhalable substances produced by heating the material may be in vapor form (i.e., a substance that is in the gas phase at a temperature lower than its critical point), the inhalable substance may be an aerosol (i.e, a suspension of fine solid particles or liquid droplets in a gas). The term aerosol used in this disclosure is meant to include vapors, gases, and aerosols whether visible or not.

The w/w physical property is defined as "Weight for weight" or "weight by weight" ("w/w"). The w/w property measures the proportion of a particular substance within a mixture, as measured by weight or mass. For example, if an aerosol precursor for a prior art "dry" solid substrate had 10 g/1 kg max for the entire substrate then its w/w value would be 1% w/w relative to the weight of the substrate while the aerosol precursor was present within the substrate (included in the total weight).

FIG. 1 shows a schematic view of a heat-not-burn tobacco product according to a first embodiment of the present invention. As shown, the heat-not-burn tobacco product 10A includes a first heating section 110 providing a front end 100*a*, a second heating section 120 providing a mouth end 100*b*, and a first thermal barrier 130 located between the first heating section 110 and the second heating section 120.

The first heating section 110 may comprise a first vapor permeable, but liquid impermeable barrier 111*a* and a second vapor permeable, but liquid impermeable barrier 111*b*. As will be explained below, the first heating section 110 may contain a liquid aerosol precursor 110*a* which exists in a free liquid state and in an unbound form, and thus, the first heating section 110 must comprise a liquid impermeable substance which has the vapor permeable, liquid impermeable barrier ends 111*a*, 111*b*.

The first heated section 110 may further include one or more flavor compounds of nicotine lactate, nicotine levulinate, nicotine benzoate, maltol, citronellyl, phenyl acetate, vanillin, ethyl vanillin, phenyl lactic acid, levulinic acid, cinnamic acid, nerolidol, caryophylene oxide, gamanonalactone, isoamyl phenyl acetate, phenylethyl isovalarate, nicotine benzoate.

As noted above, the first heating section 110 contains the liquid aerosol precursor 110*a*, and the second heating section 120 contains a solid tobacco substrate 120*a*, and the first thermal barrier 130 is vapor permeable but liquid impermeable. In other exemplary embodiments, the second heating section 120 may comprise a non-tobacco plant material. According to another exemplary embodiment, the second heating section 120 may be tobacco free and may contain a cannabinoid and comprises at least one of: cannabidiol, tetrhydrocannabinol, cannabigerol, or cannabinol.

The first heating section 110, the second heating section 120 and the first thermal barrier 130 form a part called "cigarette body".

The second heating section 120 containing the solid tobacco substrate 120*a* may further comprise barriers 112*a*, 112*b*. These barriers 112*a*, 112*b* are vapor (only) permeable barriers.

Meanwhile, the cylinder for the first heating section 110 and the cylinder for the second heating section 120 are a metal coating, laminate, or a solid metal tube made of at least one selected from metal, carbon, ceramic, plastic, and glass, for example. The two heating sections 110, 120 may be made of at least one of: metal, ceramic, plastic, carbon, a composite material or a coating, a laminate, or a printed layer on cigarette paper.

An optional thermal insulating layer 141 is wrapped around the first heating section 110 and the second heating section 120. And surrounding the optional thermal insulating layer 141 is a paper 142 to simulate the appearance of a conventional burn-down cigarette.

As noted previously, the front end 100*a* of the first heating section 110 comprises a liquid impermeable but vapor permeable barrier 111*a*. The first heating section 110 and the second heating section 120 are separated by a vapor permeable but liquid impermeable, first thermal barrier 130 made from one of glass, polymer, metal, carbon, and ceramic.

This first thermal barrier 130 may be non-heat conducting or partially heat conducting. After the first heating section 110 and the second heating section 120 are heated, the aerosol vapor generated from the first heating section 110 passes through the second heating section 120 and mixes with the aerosol vapor generated from the second heating section 120, which are to be inhaled by the consumer at the mouth end 100*b*. It is noted that, the aerosol pathway extends from the first heating section 110 to the mouth end 100*b*.

More specifically, the first heating section 110 is configured to hold one liquid or a liquid mixture of the aerosol precursors such as glycerin, propylene glycol, water, and nicotine. Preferably, the first heating section 110 further contains emulsifiers for controlling the evaporation rate of the liquid aerosol precursor 110*a*, such as microcrystalline cellulose, nanocrysttaline cellulose, cellulose nanofibrils or bacterial cellulose. The liquid aerosol precursor 110*a* may comprise at least one of: glycerin, propylene glycol, water, nicotine, and one or more flavor compounds. Suitable flavor compounds are nicotine lactate, nicotine levulinate, nicotine benzoate, maltol, citronellyl, phenyl acetate, vanillin, ethyl vanillin, penyl lactic acid, levulinic acid, cinnamic acid, nerolidol, caryophyleneoxide, gammanonalactone, isoamyl penyl acetate, phenylethyl isovalarate, nicotine benzoate, cannabidiol, tetrhydrocannabinol, cannabigerol, or cannabinol.

The liquid aerosol precursor 110*a*, prior to any heating, may exists as a free liquid within the first heating section 110. The first heating section 110 may comprise a liquid impermeable container, such as a metal container or metalized container, as noted above.

Preferably, in one exemplary embodiment, liquid aerosol precursor 110*a* exists in the first heating section 110 as a free liquid. That is, the liquid aerosol precursor 110*a* is contained in the first heating section 110 in a liquid state. The first heating section 110 may comprise a leak-proof metal cylinder which has vapor permeable, liquid impermeable barriers 111*a*, 111*b* at its ends.

In another exemplary embodiment, the liquid aerosol precursor 110*a* may be loaded on or contained within a carrier substance. The carrier substance may then be placed within the first heating section 110 comprising a leak/liquid-proof metal cylinder.

The carrier substance may comprise a preformed fibrous matrix, a porous foam, or a pleated and gathered web. A preformed carrier substance is usually completely free of any aerosol precursor but capable of high aerosol precursor loading by virtue of its inherent porosity. The carrier substance carrying the liquid aerosol precursor is usually contained/enveloped within the first heating section 110.

One carrier substance may include a preformed porous fibrous matrix that may comprise a non-woven fabric. Such non-woven fabrics may be about 40 gram per square meter in weight and can hold 200-600% liquid by weight of the fabric. Such fabrics may hold up to 1000% or more of aerosol precursor or precursor mixtures by weight of the fabric.

Preferably such fabrics for the carrier substance may be metalized with metal fibers, metal coatings or a mixture thereof to aid in heat transfer within the fibrous matrix. In other embodiments the nonwoven fabric may contain carbon fibers for heat conduction instead of metal.

When loaded on a carrier substance, the liquid aerosol precursor 110*a* is "wet" to touch when it is within the carrier substance. The liquid aerosol precursor 110*a* within its carrier substance may have a weight by weight (w/w) percentage that is between about 25.0% and about 600.0%, and preferably between about 30.0% and 200.0% (w/w) relative to the entire (total) weight of the carrier substance that includes the weight of the aerosol precursor 110*a*. According to another exemplary embodiment, the liquid aerosol may be provided as a sole liquid/single material within the first heating section, so a w/w percentage would not be applicable to such embodiments.

Meanwhile, as noted previously, the amount of aerosol precursor loaded on the prior art "dry" solid substrates is usually limited to not more than 20% by w/w. And as such, prior art solid substrates containing aerosols are "dry" to the touch while any solid carrier substance with the liquid aerosol precursor may be "wet" to the touch and will usually have a weight by weight (w/w) percentage that is between about 25.0% and about 600.0%.

In other exemplary embodiments, the liquid aerosol precursor 110*a* is loaded on to carrier substances that may include a pre-formed foam matrix, formed from polymers, metals, fibers such as, macro, micro or nanocellulose, carbon or other synthetic or natural fiber based foams having sufficient porosity and capable of holding large liquid volumes. Such foams for the carrier substance are preferably cylindrical in shape although other shapes are not excluded. The foam may be metallized for heat conduction when heat conducting carbon is not used in the foam.

In another embodiment, the liquid aerosol precursor 110*a* is loaded on a carrier substance that may include a preformed metallized fibrous sheet or web that is pleated and gathered and converted to a cylindrical shape. The sheet or web is made of at least one selected from cellulose fibers, non-cellulose synthetic fibers, metal, conductive carbon, graphite, and ceramics or a combination thereof. Heat conducting carbon fiber may be used in the absence of or in addition to metal fibers.

Such sheets, functioning as the carrier substance for the liquid aerosol precursor 110*a*, can be processed to have high porosity to hold high liquid volumes because of the formation of hollow channels during the pleating and gathering process. The liquid aerosol precursor 110*a* may be loaded on the carrier substance during formation of the carrier substance that may include a gathered sheet or after formation of the sheet and or the cylindrical or other shaped structure.

It is noted that, that the carrier substance containing the liquid aerosol precursor 110*a* in the above exemplary embodiments is preferably converted to cylindrical shapes although other shapes are not excluded from this disclosure. Other shapes include, but are not limited to, triangular prisms, rectangular prisms, pentagonal prisms, hexagonal prisms, octagonal prisms, etc.

The second heating section 120 contains a solid tobacco substrate 120*a*, such as tobacco or other botanicals in various solid forms with other flavor compounds loaded on or in the tobacco or the other botanical. Such solid tobacco substrate 120*a* can be in strands, pellets, shredded pieces, beads, gathered web, or cast sheet.

This second heating section 120 may also contain flavor compounds such as, but not limited to, alpha-ionone, methyl cyclopentenolone, geraniol, nicotine mucate, nicotine L-malate, alpha terpineol, 2-acetyl pyrrole, bet-damascene, caryophyllene, 3-methylvaleric acid, propylene glycol, caproic acid, menthol, phenyl ethyl alcohol, benzyl alcohol, anethole, ethyl phenylacetate, phenyl ethyl butyrate, 2-methylbutyric acid, benzaldehyde, methyl salicylate, 3-acetylpyridine, para-tolyaldehyde, 2-methyl pyrazine, limonine, gama-valerolactone, linalool, isovaleric acid, gamma-valerolactone, tetramethylpyrazine, ethyl caproate. In some embodiments, this second heating section 120 may contain non-tobacco materials.

The non-tobacco botanicals include at least one of cannabidiol, tetrahydrocannabinol, cannabigerol, and cannabinol. The second heating section may also comprise vapor permeable barriers 112*a*, 112*b* at its ends which seal the solid tobacco substrate 120*a* within the second heating section 120.

The first heating section 110 is usually heated to a temperature not higher than 300.0° C., since less energy is required to vaporize the liquid aerosol precursor 110*a* within the first heating section 110. And with the thermal barrier 130 between the first heating section 110 and second heating section 120, and since the first heating section is usually heated with a temperature not higher than 300.0° C., the second heating section 120 may be heated to a temperature not higher than 200.0° C. This lower temperature of 200.0° C. or lower for the second heating section 120 may prevent or substantially reduce formation of undesirable tobacco based chemical compounds.

Figure 2:
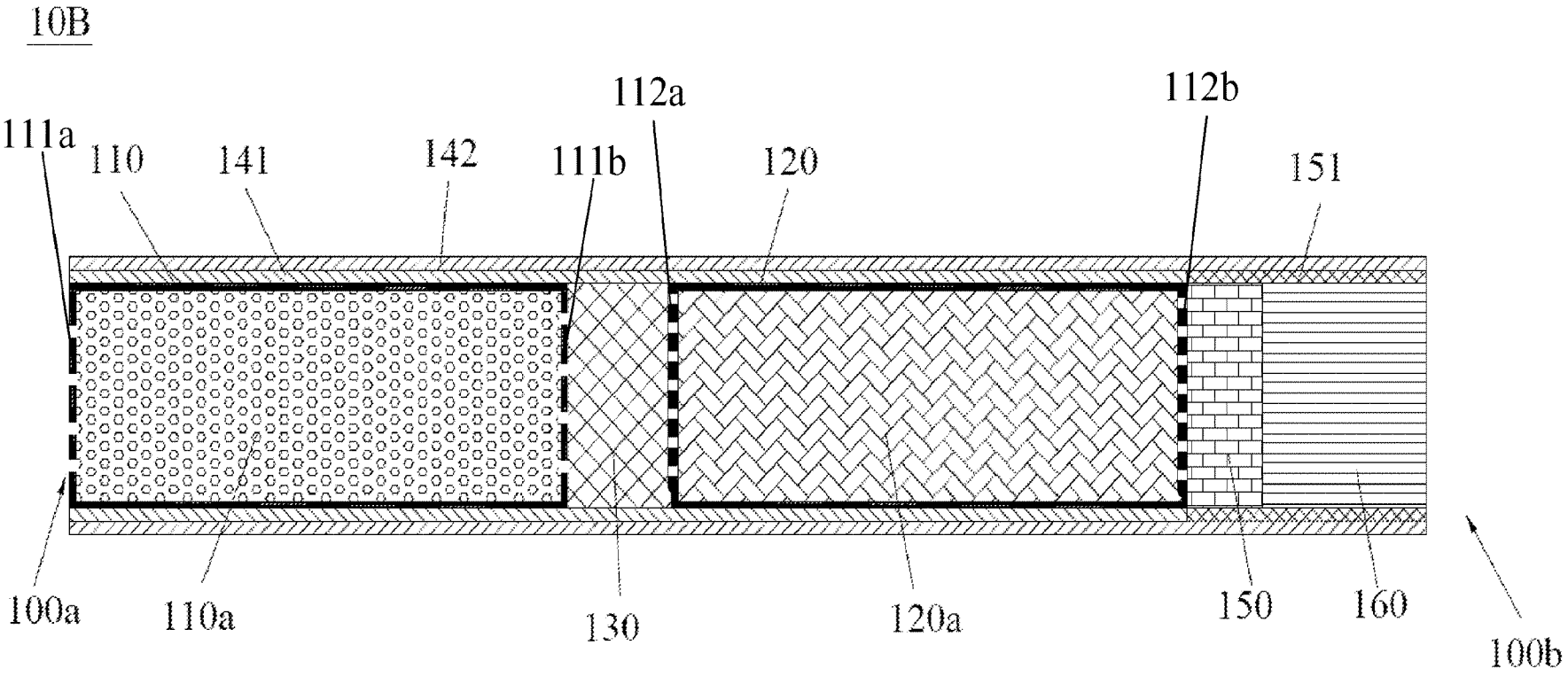
FIG. 2 is a schematic view of a heat-not-burn tobacco product according to a second embodiment of the present invention.

FIG. 2 shows a schematic view of a heat-not-burn tobacco product according to a second embodiment of the present invention. As illustrated, the HNB tobacco product 10B in the embodiment is similar to the first embodiment of FIG. 1, except for the below differences:

The HNB tobacco product 10B further includes a cooling section 150 connected with the mouth end 100*b* of the second heating section 120, and a filter 160 connected with the cooling section 150. Specifically, the cooling section 150 includes phase change materials or cooling materials including at least one selected from metals, ceramics, and polymers or combination thereof.

The filter 160 is made of fibers such as cellulose acetate, cellulose, polypropylene, polylactic acid or a paper filter. More specifically, sufficient holes are provided on the cooling section 150 and the filter 160 to allow the aerosol to pass. Additionally, a plug wrap 151 is wrapped around the cooling section 150 and the filter 160, and the outer paper wrap 142 is extended to wrap the plug wrap 151. In the present invention, the first heating section 110 and the second heating section 120 are controlled at different temperatures, so as to minimize the formation of heat induced toxic chemical compounds such as TSNA's (Tobacco Specific Nitrosamines) typically formed when tobacco is heated to the temperature above 200.0° C. Specifically, the heating temperature of the first heating section 110 is not higher than 300.0° C., and the heating temperature of the second heating section 120 is not higher than 200.0° C., and the heating can be achieved by ignition heating or electrical heating.

Figure 3:
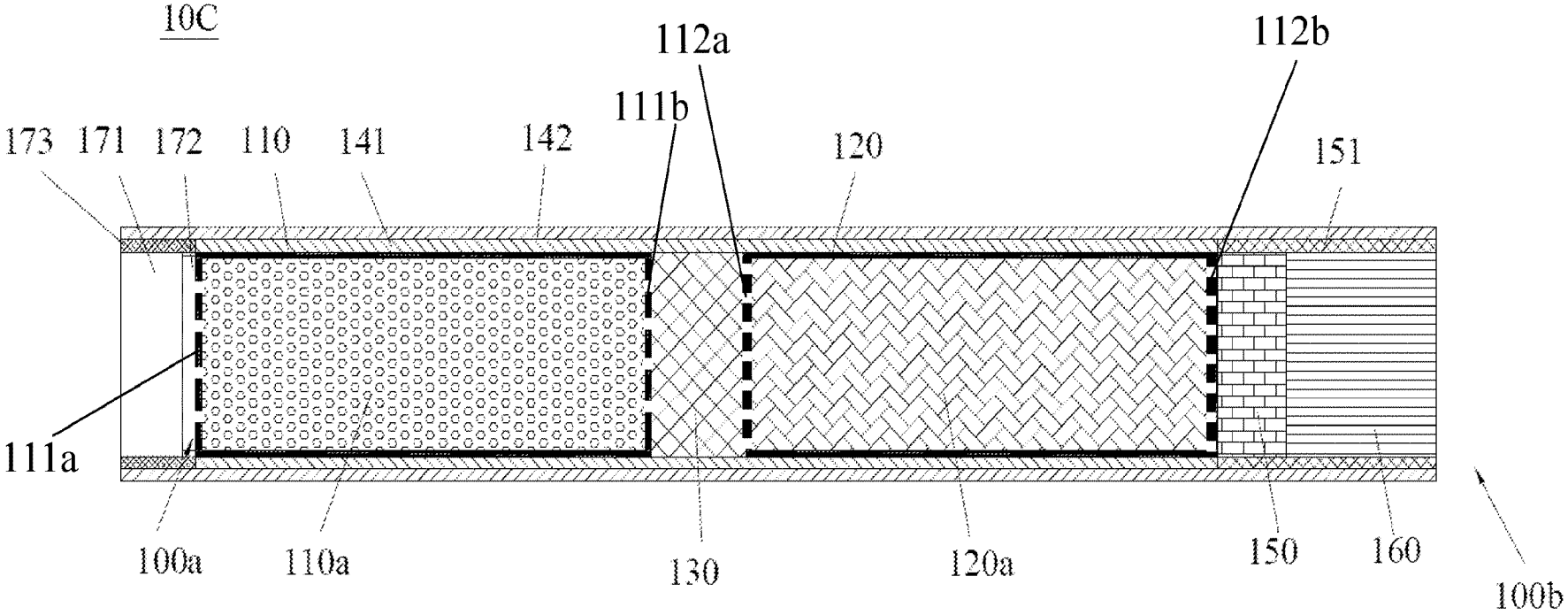
FIG. 3 is a schematic view of a heat-not-burn tobacco product according to a third embodiment of the present invention.

FIG. 3 shows a HNB tobacco product 10C by using ignition heating, as shown, a carbon based ignition source 171 is connected to the front end 100*a* of the first heating section 110, and a second thermal barrier 172 is configured between the carbon based ignition source 171 and the first heating section 110.

Specifically, the carbon based ignition source 171 is lit by a lighter and upon ignition may reach temperatures around 900.0° C. This high temperature needs to be reduced to about 300.0° C. by use of the second thermal barrier 172 to heat the liquid aerosol precursor 110*a* in the first heating section 110. Preferably, the second thermal barrier 172 may be, air permeable, partially permeable or impermeable and may be formed from glass, metal, ceramic, carbon, polymer or a combination thereof.

However, the second thermal barrier 172 can be omitted in other embodiments. Meanwhile, a third thermal barrier 173 may be connected outside of the carbon based ignition source 171 for preventing an over-high temperature. Preferably, the second section temperature is maintained below 200.0° C. by means such as air gap, cooling materials, fiber bundle, gathered fiber web, metals, carbons, and ceramics, polymers, or composites materials thereof.

In some preferable embodiments, multiple air ventilation holes 199 (See FIGS. 6-8) may be provided in the heat-not-burn tobacco product 10C, so as to adjust or dilute any ingredient of the inhalable aerosol, for example, the air ventilation holes may be located between the first heating section 110 and the second heating section 120, between the cooling section 150 and the filter 160, or on the cooling section 150 and the filter 160, on the second barrier 172 and/or the third barrier 173.

Figure 4:
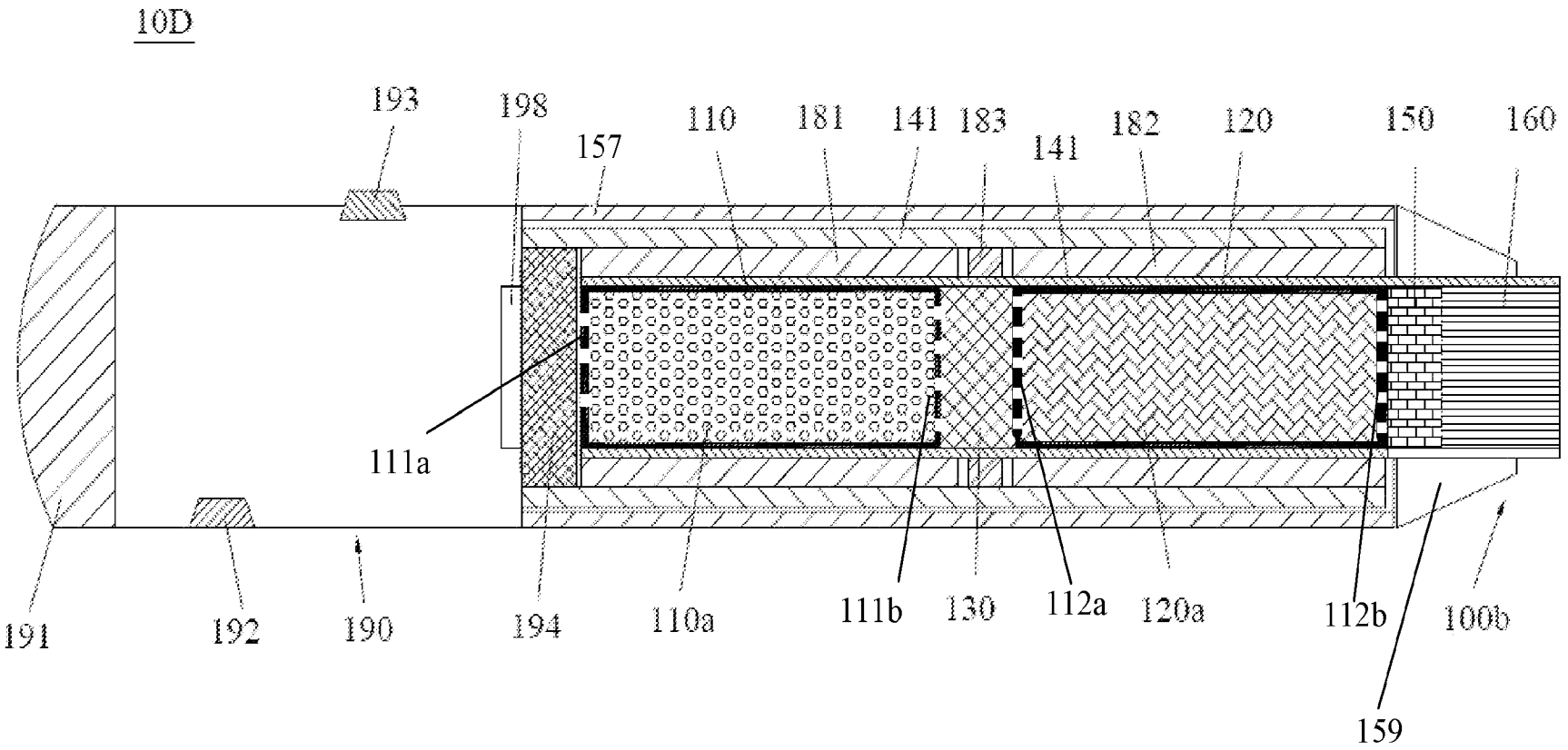
FIG. 4 is a schematic view of a heat-not-burn tobacco product according to a fourth embodiment of the present invention.

FIG. 4 shows a HNB tobacco product inserted in to a device capable of heating by using electrical heating. As shown, the HNB tobacco product 10D further includes a first heater 181 connected with the first heating section 110, and a second heater 182 connected to the second heating section 120 of the electrical heating device.

That is, the first and the second heating sections 110, 120 are heated separately to control the heating temperature of the first heating section 110 not higher than 300° C., the heating temperature of the second heating section 120 not higher than 200° C. Specifically, the first heater 181 surrounds the first heating section 110, the second heater 182 surrounds the second heating section 120, and the first heater 181 and the second heater 182 are separated by an insulating layer 183.

The electrical heating device 190 is electrically connected at the front end 100*a* of the cigarette body to control the heating. Such a heating is accomplished by resistive heating, inductive heating or solid state microwave heating. Specifically, the heating device 190 includes a power source (not shown), a PCB (not shown), a microcontroller (not shown), a LED indicator 191, a charge interface 192 and a push button 193 that are connected. Although not shown, activation may be achieved by a puff activator or by a sensor that detects the presence of the cigarette within the heater.

Specifically, the power source supplies electricity for the whole tobacco product. The power source may take on various implementations, preferably, the power source is sized to fit conveniently within the device 190 so the device can be easily handled, and the power source may be able to deliver sufficient power to rapidly heat the first heating section 110 and the second heating section 120 in a short time.

Preferably, the power source can be a replaceable battery or a rechargeable battery, such as solid state battery, thin-film solid state battery, lithium-ion batteries (such as rechargeable lithium-manganese dioxide battery), or rechargeable supercapacitor or the like. In particular, lithium polymer batteries can be used as such batteries can provide increased safety. Other types of batteries such as nickel-cadmium cells may also be used.

Preferably, if a rechargeable battery is used, the power source can be connected to a wall charger, a car charger (i.e., cigarette lighter receptacle) or a computer, such as through a universal serial bus (USB) cable or connector (e.g., USB 2.0, 3.0, 3.1 USB Type-C), or connected to a photovoltaic cell (solar cell) or solar panel or solar cells, wireless charger, or wireless radio frequency (RF) based charger. Preferably, the control device 190 is further provided with a wireless communication unit connected to the microcontroller, by means of which the tobacco product can communicate with a handheld device such as a mobile phone, a laptop, a tablet or the like, thereby detecting the status of the device or the functionality of the remote control device 190 or periodically upgrading the software within the microcontroller.

In other embodiments, the power source may include a capacitor. Capacitors are capable of discharging more quickly than batteries and can be charged while the tobacco product is heated, thereby allowing the battery to discharge into the capacitor at a lower rate than if it was used to power the tobacco product directly.

For example, a supercapacitor, e.g., an electrical double layer capacitor may be used separately from or in combination with a battery. When used alone, the supercapacitor may be recharged before each use of the device. Therefore, the tobacco product may also include a charger component that can be attached to the heater before using to replenish the supercapacitor.

In other embodiments, the first heater 181 and the second heater 182 may be a conductive heater and/or an inductive heater or a solid state microwave heater. For example, the conductive heater includes a resistive heating member which is configured to produce heat when electrical current passes through it.

The conductive heater uses electrical conductive materials having low mass, low density, and moderate resistivity. Exemplarily, the material may include, but are not limited to, carbon, graphite, carbon-graphite composites, metals, and ceramics such as metallic and non-metallic carbides nitrides, oxides, silicides, intermetallic compounds, cermets, metal alloys and metal foils. In particular, refractory materials may be useful. Useful metals that may be used, for example are, nickel, chromium, alloys of nickel and chromium (nichrome) and various types of steel. Mixtures of above different materials also can be used to obtain desired resistivity or thermal conductivity.

Preferably, in one embodiment, the LED indicator 191 is connected with the micro controller for indicating status of the heaters with respect to battery power or the temperature of the heaters. For example, a green light may indicate that the heaters have reached its pre-set temperature, a yellow light may indicate that the heaters are still warming, while a red light may indicate that the battery needs charging. Of course, various other kinds of indicator light functions are possible.

Preferably, the push button 193 is connected with the power source for controlling the activating the heaters. Specifically, the push button 193 is protruded from the housing of the device 190 for easy operation. After the pre-set temperature is reached, the heaters are stopped automatically, without having to operate the push button 193.

In the present embodiment, the control device 190 is electrically connected with the first heater 181 through a base heater 194. Specifically, the base heater 194 is connected with the first heater 181 by means of a fixture 198. In some embodiments the base heater 194 may be omitted. In other embodiments the first heater 181 may be omitted.

In some preferable embodiments, multiple air ventilation holes (not shown) may be provided in the heat-not-burn tobacco product 10D, so as to adjust or dilute any ingredient of the inhalable aerosol, for example, the air ventilation holes may be located between the first heating section 110 and the second heating section 120, between the cooling section 150 and the filter 160, or on the cooling section 150 and the filter 160.

In the present embodiment shown in FIG. 4, the cooling section 150 and the filter 160 are configured in the cigarette body as mentioned in the second embodiment of FIG. 2. A mouthpiece 159 may surround cooling section 150 and filter 160. The mouthpiece 159 may comprise a plastic material, and it may or may not be heat resistant.

And relative to the first heating section 110, a first optional thermal insulation layer 141 is positioned as illustrated in FIG. 4. Around the first optional thermal insulation layer 141 is the first heater 181. Around the first heater 181 is a second optional thermal insulation layer 141. And outside of the second optional thermal insulation layer 141 is an outer body material 157. The outer body material 157 may comprise a plastic material which is heat resistant.

Figure 5:
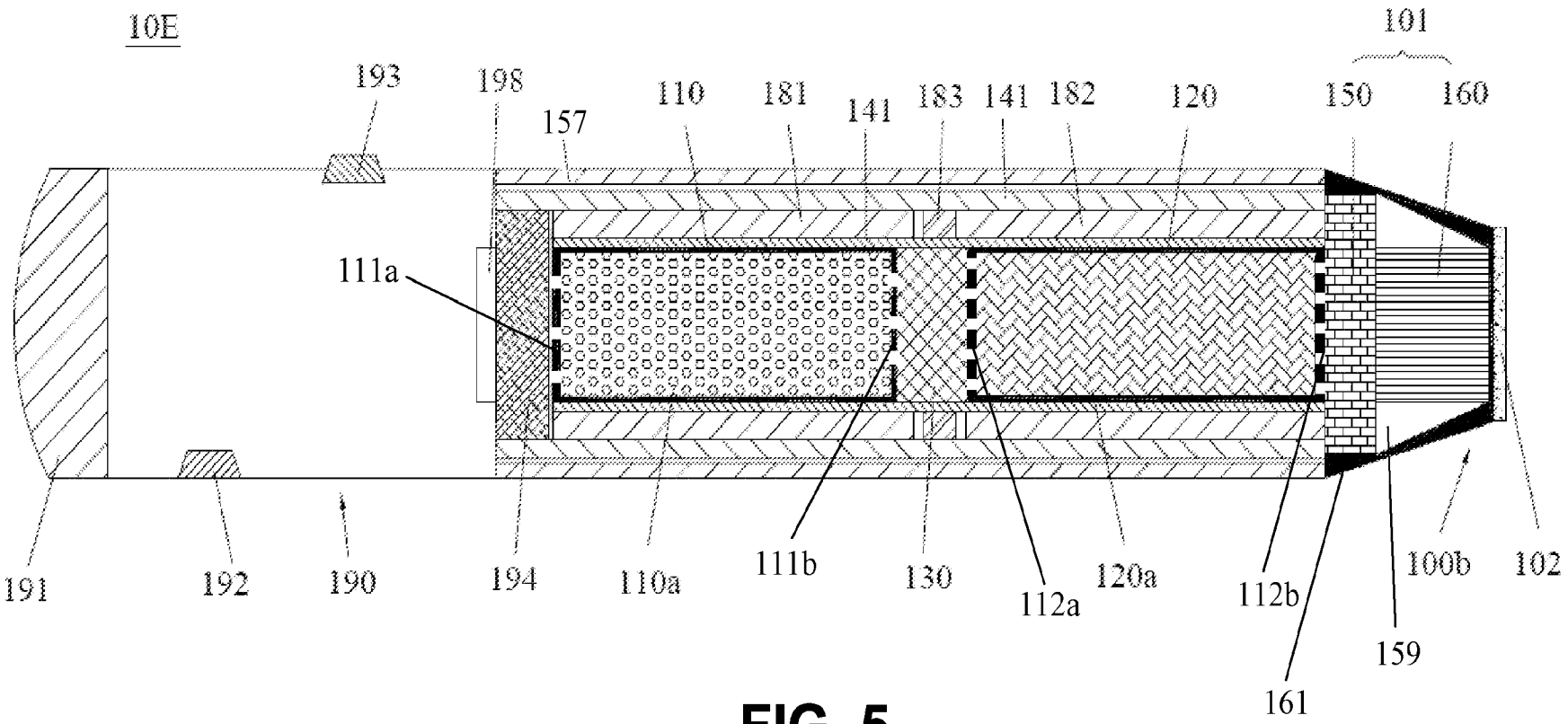
FIG. 5 is a schematic view of a heat-not-burn tobacco product according to a fifth embodiment of the present invention.

However, in other embodiments, the cooling section 150 and the filter 160 may be configured out of the cigarette body. Referring now to FIG. 5, the cooling section 150 and the filter 160 form, along with an inner section 159 and outer section 161, a detachable mouth piece 101 detachably connected to the housing of the HNB tobacco product 10E. Preferably, a removable lid 102 is provided on the mouth piece 101 to open or close the mouth piece. The inner section 159 and outer section 161 of the mouthpiece 101 may be made from a plastic material or metal, or a combination thereof.

Figure 6:
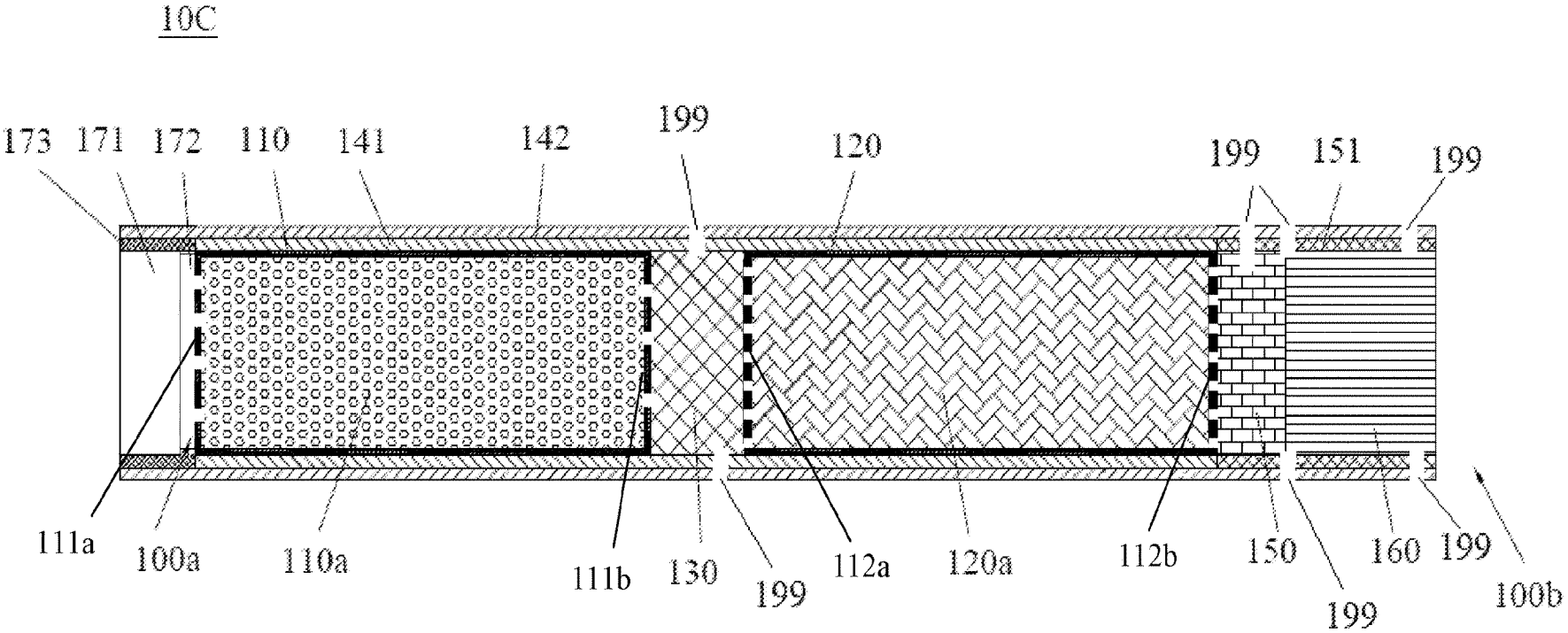
FIG. 6 is a schematic view of a heat-not-burn tobacco product according to a third embodiment of the present invention, similar to FIG. 3, but with ventilation holes.

Referring now to FIG. 6, this figure is a schematic view of a heat-not-burn tobacco product 10C according to a third embodiment of the present invention, similar to FIG. 3, but with ventilation holes 199. Ventilation holes 199 may be provided near the thermal barrier 130 that penetrate through the paper layer 142 and thermal insulating layer 141. Holes 199 may be provided near or in the cooling section 150 and the filter 160.

Figure 7:
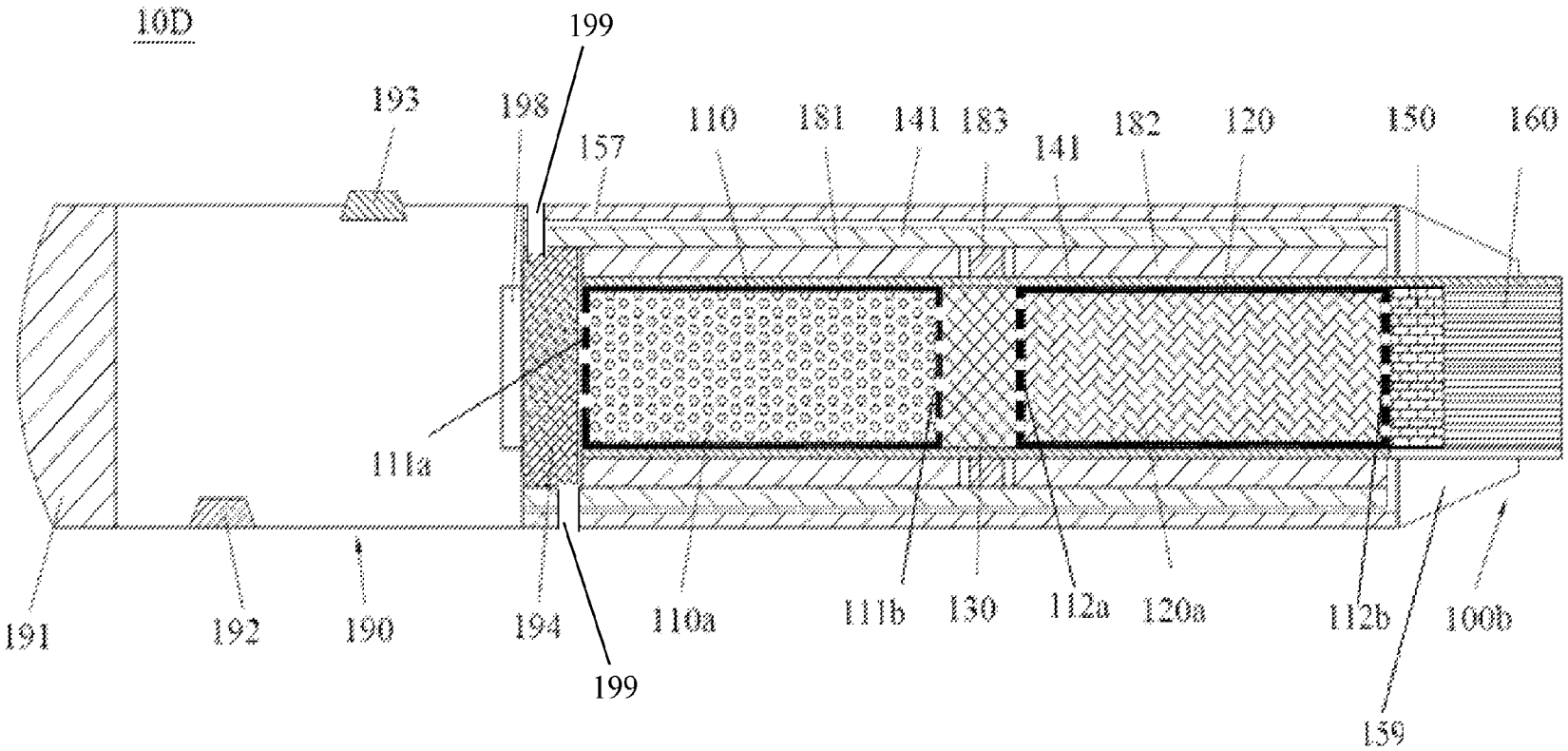
FIG. 7 is a schematic view of a heat-not-burn tobacco product according to a fourth embodiment of the present invention similar to FIG. 4, but with ventilation holes.

Referring now to FIG. 7, this figure is a schematic view of a heat-not-burn tobacco product 10D according to a fourth embodiment of the present invention similar to FIG. 4, but with ventilation holes 199. According to this exemplary embodiment, the holes 199 may penetrate through the outer body material 157 and through a thermal insulating layer 141 to the base heater 194.

Figure 8:
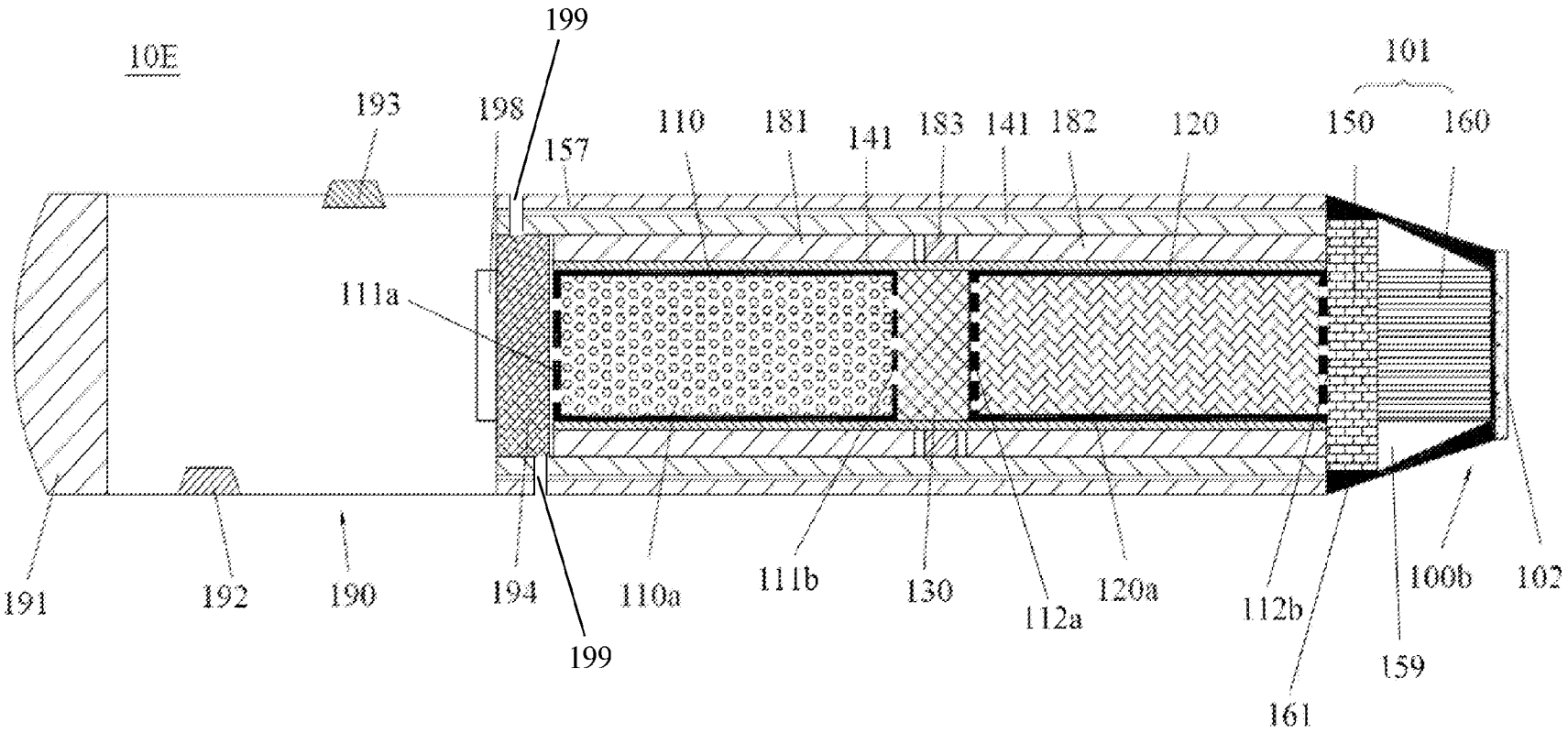
FIG. 8 is a schematic view of a heat-not-burn tobacco product according to a fifth embodiment of the present invention, similar to FIG. 5, but with ventilation holes.

Referring now to FIG. 8, this figure is a schematic view of a heat-not-burn tobacco product 10E according to a fifth embodiment of the present invention, similar to FIG. 5, but with ventilation holes 199. Like FIG. 7, the holes 199 may penetrate through the outer body material 157 and through a thermal insulating layer 141 to the base heater 194.

In the present invention, the shape of the housing of the HNB tobacco product is variable. In some embodiments, the housing is generally an elongated cylindrical rod or tube. The housing may be an integral structure that is not removable, or include detachable two or more parts, such as the mouth piece, the cigarette body, and the control device 190. Preferably, the shape of the housing is consistent with the shape of the mouth piece and the cigarette body such as the first and second heating sections 110, 120. The shape of the HNB tobacco product is not limited in this invention.

In conclusion, the HNB tobacco product according to the present invention includes two heating sections for separating the liquid aerosol precursor and the solid tobacco substrate. The liquid aerosol precursor exists in the first heating section as a free liquid in an unbound form.

The liquid aerosol precursor as the first heating section provides a front end, and the solid tobacco substrate as the second heating section provides a mouth end, further the first thermal barrier is formed between the first heating section and the second heating section to control the temperature, as a result, the heating temperature of the solid tobacco substrate is lower than that of the liquid aerosol precursor when heating, such as to minimize the formation of heat induced toxic chemical compounds such as TSNA's (Tobacco Specific Nitrosamines) typically formed when tobacco is heated to high temperatures. Furthermore, the separation configuration of the two heating sections is simple, which reduces manufacturing costs.

In addition, the present invention also provides a method of making a heat-not-burn tobacco product, which includes the following steps:

forming a first heating section with a front end provided, the first heating section containing a liquid aerosol precursor;

forming a second heating section with a mouth end providing, the second heating section containing a solid tobacco substrate; and forming a first thermal barrier that is vapor permeable but liquid impermeable located between the first heating section and the second heating section.

Preferably, the method further includes loading the liquid aerosol precursor on to a pre-formed fibrous matrix, a pre-formed porous foam, or a pre-formed pleated and gathered web.

Preferably, the method further includes forming a cooling section connected with the mouth end of the second heating section; and forming a filter connected with the cooling section.

As an embodiment, the method further includes:

forming a carbon based ignition source connected to the front end of the first heating section; and forming a second thermal barrier between the carbon based ignition source and the first heating section, thereby controlling the first heating section be heated to a temperature not higher than 300.0° C., and the second heating section be heated to a temperature less than 200.0° C.

As another embodiment, the method further includes:

forming a first heater connected with the first heating section; and forming a second heater connected to the second heating section, thereby controlling the first heating section be heated to a temperature not higher than 300.0° C., and the second heating section be heated to a temperature not higher than 200.0° C.

As noted above, and in addition to the above, the carrier substance for the liquid aerosol 110*a* may comprise: a fibrous matrix, the porous foam, and pleated and gathered webs. The fibrous matrix, the porous foam, and the pleated and gathered webs may be made heat conductive by incorporating metal, conductive carbon, graphite, ceramic or a mixture of these materials. The liquid aerosol precursor 110*a* may include microcrystalline cellulose, nanocrysttaline cellulose, cellulose nanofibrils or bacterial cellulose as emulsifiers, viscosity modifying agents or as control agents for controlling the evaporation rate of the aerosol precursors.

The second heated section 120 may be loaded with tobacco or other botanicals in various solid forms and other flavor compounds loaded on or in the tobacco or the other botanical, such solids can be in strands, pellets, shredded pieces, beads, gathered web, or cast sheet, with or without a binder polymer or nanocellulose as a binder.

The two heated sections 110, 120 may be surrounded by a heat insulating layer made of glass, carbon, ceramic, plastic, composite material of these or a coating or laminate of these on paper. Meanwhile, for any of the embodiments, an outer cigarette paper wrap 142 may extend the entire length of the consumable 10.

The front of the consumable 10 may have a heating element 194 and a fixture for making electrical contact with the heating element or heater 194. The front end of the consumable 10 may have a carbon based ignition source 171 and a thermal barrier 172 to heat the first heated section 110 to a temperature not to exceed 300 deg C.

An aerosol pathway may extend from the first heated section 110 to the mouth end 100*b* of the consumable 10. The back end of the consumable 10 may have an aerosol cooling section 150 containing phase change materials: polymeric fibers or films in bundle form, or cooling materials made of metals, ceramics, or polymers that are porous enough to allow passage of the aerosol.

The back end of the consumable 10 may have an aerosol filtering section 160 made of fibers such as cellulose acetate, cellulose, polypropylene, polylactic acid or a paper filter. The first heated section 110 and the second heated section 120 may be made of metal, carbon, ceramic, or a composite material. The composite material may be made out of metal, carbon, or ceramic printed on a plastic surface such that the two heated segments are separated by a unheated segment, such as by the thermal barrier 130.

The heater 194 may be powered by a battery, a super capacitor or a combination thereof. The heater 194 may be controlled by a printed circuit board (PCB) and/or a micro-controller. The heater 194 may have an LED indictor 191 and a push button 193 on/off activation. The heater 194 may be puff activated (i.e. from a vacuum created by a consumer) or activated by the presence of the cigarette.

A heater 194 or heating in general of the consumable 10, may be accomplished by resistive heating, inductive heating or solid state microwave heating. The heater 194 may have air ventilation holes 199 so as to adjust the draw and or dilute any ingredient of the inhalable aerosol generated from the aerosol precursor 110*a*.

The exemplary embodiments of the inventive method and system described above are interchangeable as understood by one of ordinary skill in the art. Various embodiments may be combined with other embodiments without departing from the scope of this disclosure. That is, one or more embodiments illustrated in the several figures may be combined together.

As but one non-limiting example of a potential combination of exemplary embodiments, the exemplary embodiment illustrated in FIG. 5 could be combined with prior embodiments in other figures, such as, but not limited to, those found in FIG. 4, such as using the mouth piece 101 of FIG. 5 in FIG. 4. Other combinations of the exemplary embodiments are possible and are included within the scope of this disclosure as understood by one of ordinary skill in the art.

For example, as another non-limiting example of a potential combination of exemplary embodiments, the second heating section 120 may be eliminated and the first heating section 110 may be heated by the base and a wall heater. This exemplary embodiment may also contain at least one of: glycerin, propylene glycol, water, nicotine, cannabidiol, tetrhydrocannabinol, cannabigerol, or cannabinol, nicotine lactate, nicotine levulinate, nicotine benzoate, maltol, citronellyl, phenyl acetate, vanillin, ethyl vanillin, phenyl lactic acid, levulinic acid, cinnamic acid, nerolidol, caryophylene oxide, gamanonalactone, isoamyl phenyl acetate, phenylethyl isovalarate, nicotine benzoate.

As another variation, the second heating section 120 may be retained and it may contain the same aerosol former ingredients as (1) above but the two sections 110, 120 are heated at different rates so that when the ingredients of the second heating section 120 are about to be depleted, the ingredients of the first heated section 110 begin to form the aerosol for a continuous supply of the inhalable aerosol.

In addition to above, certain steps in the processes enabled by the mechanical drawings in this specification naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention.

While the invention has been described in connection with what are presently considered to be the most practical and preferable embodiments, it is to be understood that the invention is not to be limited to the disclosed embodiments, but on the contrary, is intended to cover various modifications and equivalent arrangements included within the spirit and scope of the invention.

What is claimed is:

1. A heat-not-burn tobacco aerosol source member for producing an inhalable aerosol, comprising:

a first heating section comprising a first hollow structure with a first end and a second end, the first end and second end comprising a liquid impermeable but vapor permeable barrier to allow movement of a vaporized aerosol from the first end through the second end, the first heating section containing a liquid aerosol precursor;

a second heating section comprising a second hollow structure with a mouth end and a heated end, the mouth end and heated end each comprising a liquid impermeable but vapor permeable barrier to allow movement of the vaporized aerosol from the first heating section and vapors formed from a solid tobacco substrate or a non-tobacco plant material, the vapors being formed in the second heating section from heat transferred by the vaporized aerosol from the first heating section to a first thermal, vapor permeable liquid barrier layer that contacts the heated end; the second heating section containing the solid tobacco substrate, or the non-tobacco plant material; and the first thermal barrier comprising a porous material that is vapor permeable but liquid impermeable located between the first heating section and the second heating section and which substantially reduces heat transfer from the first heating section to the second heating section while permitting flow of the vaporized aerosol from the first heating section into the second heating section.

2. The heat-not-burn tobacco aerosol source member according to claim 1, wherein the liquid aerosol precursor is loaded on a carrier substance and the liquid aerosol precursor vaporizes and moves from the carrier substance through the second end once heated.

3. The heat-not-burn tobacco aerosol source member according to claim 1, wherein the liquid aerosol precursor exists in the first heating section as a free liquid in an unbound form.

4. The heat-not-burn tobacco aerosol source member according to claim 1, wherein the first heating section has a cylindrical shape, the second heating section has a cylindrical shape, and the first thermal barrier has a cylindrical shape.

5. The heat-not-burn tobacco aerosol source member according to claim 1, wherein the liquid aerosol precursor is loaded on a carrier substance that occupies a volume defined by the first hollow structure and the first and second ends.

6. The heat-not-burn tobacco aerosol source member according to claim 1, wherein the vaporized aerosol from the first heating section and vapors formed within the second heating section moves from the heated end through the mouth end.

7. The heat-not-burn tobacco aerosol source member according to claim 1, wherein the first heating section further comprises a carrier substance, the carrier substance comprising at least one of: a fibrous matrix, a porous foam, or a pleated and gathered web; and the liquid aerosol precursor is loaded on to the carrier substance.

8. The heat-not-burn tobacco aerosol source member according to claim 1, further comprising a cooling section connected with the mouth end of the second heating section, and a filter connected with the cooling section.

9. The heat-not burn tobacco aerosol source member according to claim 1, further comprising a carbon based ignition source connected to the front end of the first heating section.

10. The heat-not-burn tobacco aerosol source member according to claim 9, wherein a second thermal barrier is configured between the carbon based ignition source and the first heating section.

11. A heat-not-burn tobacco aerosol source member for producing an inhalable aerosol comprising:

a first heating section comprising a first hollow structure with a first end and a second end, the first end and second end comprising a liquid impermeable but vapor permeable barrier to allow movement of a vaporized aerosol from the first end through the second end, the first heating section containing a liquid aerosol precursor;

a second heating section comprising a second hollow structure with a mouth end and a heated end, the mouth end and heated end each comprising a liquid impermeable but vapor permeable barrier to allow movement of the vaporized aerosol from the first heating section and vapors formed from a solid tobacco substrate or a non-tobacco plant material, the vapors being formed in the second heating section from heat transferred by the vaporized aerosol from the first heating section to a first thermal, vapor permeable liquid barrier layer that contacts the heated end; the second heating section containing the solid tobacco substrate, or the non-tobacco plant material; and the first thermal barrier comprising a porous material that is vapor permeable but liquid impermeable located between the first heating section and the second heating section and which substantially reduces heat transfer from the first heating section to the second heating section while permitting flow of the vaporized aerosol from the first heating section into the second heating section;

the second heated section containing a solid tobacco or other botanical matter, wherein the first heated section is heated to a temperature less than 300 deg C. and the second heated section is heated to a temperature less than 200 Deg C by a heat source; and a paper layer is positioned outside of the first and second heated sections.

12. The heat-not-burn tobacco aerosol source member according to claim 11, wherein the liquid aerosol precursor is loaded on a carrier substance and the liquid aerosol precursor vaporizes and moves from the carrier substance through the second end once heated.

13. The heat-not-burn tobacco aerosol source member according to claim 11, wherein the liquid aerosol precursor exists in the first heating section as a free liquid in an unbound form.

14. The heat-not-burn tobacco aerosol source member according to claim 11, wherein the first heating section has a cylindrical shape, the second heating section has a cylindrical shape, and the first thermal barrier has a cylindrical shape.

15. The heat-not-burn tobacco aerosol source member according to claim 11, wherein the liquid aerosol precursor is loaded on a carrier substance that occupies a volume defined by the first hollow structure and the first and second ends.

16. A heat-not-burn tobacco aerosol source member for producing an inhalable aerosol comprising:

a first heating section comprising a first hollow structure with a first end and a second end, the first end and second end comprising a liquid impermeable but vapor permeable barrier to allow movement of a vaporized aerosol from the first end through the second end, the first heating section containing a liquid aerosol precursor;

a second heating section comprising a second hollow structure with a mouth end and a heated end, the mouth end and heated end each comprising a liquid impermeable but vapor permeable barrier to allow movement of the vaporized aerosol from the first heating section and vapors formed from a solid tobacco substrate or a non-tobacco plant material, the vapors being formed in the second heating section from heat transferred by the vaporized aerosol from the first heating section to a first thermal, vapor permeable liquid barrier layer that contacts the heated end; the second heating section containing the solid tobacco substrate, or the non-tobacco plant material; and the first thermal barrier comprising a porous material that is vapor permeable but liquid impermeable located between the first heating section and the second heating section and which substantially reduces heat transfer from the first heating section to the second heating section while permitting flow of the vaporized aerosol from the first heating section into the second heating section;

the second heated section containing a solid tobacco or other botanical matter, wherein the first heated section is heated to a temperature less than 300 deg C. and the second heated section is heated to a temperature less than 150 Deg C by a heat source; and a paper layer positioned outside of the first and second heated sections, and a thermal layer positioned between the paper layer and each heated section.

17. The heat-not-burn tobacco aerosol source member according to claim 16, wherein the liquid aerosol precursor is loaded on a carrier substance and the liquid aerosol precursor vaporizes and moves from the carrier substance through the second end once heated.

18. The heat-not-burn tobacco aerosol source member according to claim 16, wherein the liquid aerosol precursor exists in the first heating section as a free liquid in an unbound form.

19. The heat-not-burn tobacco aerosol source member according to claim 16, wherein the first heating section has a cylindrical shape, the second heating section has a cylindrical shape, and the first thermal barrier has a cylindrical shape.

20. The heat-not-burn tobacco aerosol source member according to claim 16, wherein the liquid aerosol precursor is loaded on a carrier substance that occupies a volume defined by the first hollow cylindrical structure and the first and second ends.

* * * * *